United States Patent [19]

Nakajima et al.

[11] Patent Number: 4,505,246

[45] Date of Patent: Mar. 19, 1985

[54] METHOD FOR OPERATING A CLOSED LOOP AIR/FUEL RATIO CONTROL SYSTEM OF AN INTERNAL COMBUSTION ENGINE

[75] Inventors: Toyohei Nakajima, Shiki; Takehiko Hosokawa, Yokohama, both of Japan

[73] Assignees: Honda Giken Kogyo Kabushiki Kaisha, Matsushita; Matsushita Electric Industrial Co., Ltd., Osaka, both of Japan

[21] Appl. No.: 524,051

[22] Filed: Aug. 17, 1983

[30] Foreign Application Priority Data

Aug. 19, 1982 [JP] Japan ..... 57-143732

[51] Int. Cl.[3] ..... F02M 51/00

[52] U.S. Cl. ..... 123/489; 123/440; 73/23

[58] Field of Search ..... 123/489, 440; 73/23

[56] References Cited

U.S. PATENT DOCUMENTS

| | | | |
|---|---|---|---|
| 4,019,470 | 4/1977 | Asano | 123/489 |
| 4,153,023 | 5/1979 | Asano et al. | 123/489 |
| 4,170,967 | 10/1979 | Wessel et al. | 123/489 |
| 4,178,793 | 12/1979 | Bremer et al. | 123/489 |
| 4,279,231 | 7/1981 | Lindberg et al. | 123/489 |
| 4,294,216 | 10/1981 | Abo et al. | 123/489 |
| 4,345,562 | 8/1982 | Drews et al. | 123/489 |
| 4,354,468 | 10/1982 | Sone et al. | 123/440 |

*Primary Examiner*—Parshotam S. Lall

*Attorney, Agent, or Firm*—Pollock, VandeSande & Priddy

[57] ABSTRACT

A method for operating a closed loop air/fuel ratio control system of an internal combustion engine determining the quantity of fuel to be supplied to the engine in accordance with an output signal of an exhaust gas oxygen sensor placed in an exhaust system of the engine, comprising steps for initiating a supply of an electric current to the exhaust gas oxygen sensor immediately after an ignition switch is turned on and for discriminating the activation state of the oxygen sensor by comparing the level of a combined output voltage of the oxygen sensor with a predetermined reference voltage level, at a time when a predetermined time period has passed after the supply of the electric current to the oxygen sensor, whereby eliminating a mistake of judgment which might occur due to the delay characteristics of a controller unit which determines the operational sequence of closed loop air/fuel ratio control system.

6 Claims, 5 Drawing Figures

METHOD FOR OPERATING A CLOSED LOOP AIR/FUEL RATIO CONTROL SYSTEM OF AN INTERNAL COMBUSTION ENGINE

FIELD OF THE INVENTION

The present invention relates to a method for operating a closed loop air/fuel ratio control system of an internal combustion engine, and more specifically to a method which prevents a malfunction of the closed loop control system during a period after the starting of the engine.

DESCRIPTION OF BACKGROUND INFORMATION

In a closed loop air/fuel ratio control system of an internal combustion engine, an air/fuel ratio of a mixture to be delivered to cylinders is controlled in accordance with an output signal of an exhaust gas oxygen sensor (which will be referred to as an $O_2$ sensor hereinafter) placed in an exhaust system of the engine for measuring oxygen content in the exhaust gas. The $O_2$ sensor is supplied with a current from a current source and a voltage level of the output signal is considered to be a summation of an electrical potential of the electromotive force and an electrical potential due to a product of the value of an internal resistance and the value of the current supplied thereto. Therefore, the output signal will be referred to as a combined output voltage. Since a sufficient temperature rise is required for the activation of the $O_2$ sensor, it is general to detect the activation state of the $O_2$ sensor during the engine starting operation which is initiated by the operation of an ignition switch. By this detection process, it becomes possible to eliminate an operation of the closed loop control system on the basis of a false information of the oxygen content. However, in prior art arrangement, since the detection of activation of the $O_2$ sensor is performed immediately after the operation of the ignition switch, there was a risk that the $O_2$ sensor is falsely judged to be activated. This is due to a response characteristic of the control circuit which receives an output signal of the $O_2$ sensor. More precisely, if the magnitude of the current to be supplied to the $O_2$ sensor is very small, the product of the value of the internal resistance and the value of the supply current will remain at a low level even though the internal resistance value is still high. In the event such a false discrimination takes place, the closed loop control would be initiated improperly, and in which the air-fuel ratio is controlled irrespectively of the actual oxygen content in the exhausted gas. Such an improper operation of the closed loop control would deteriorate the engine performance, the fuel economy and the emission characteristics.

SUMMARY OF THE INVENTION

An object of the present invention is therefore to provide a method for operating a closed loop air-fuel ratio control system of an internal combustion engine, in which the above drawback of the prior art system is eliminated and the discrimination of the activating state of the $O_2$ sensor is performed without mistake.

Another object of the present invention is to provide a method for operating a closed loop air-fuel ratio control system which can always provide an air-fuel mixture of a desirable air-fuel ratio at any time, including an engine starting period, thereby improving the driveability and the emission characteristics of the engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following description taken in conjunction with the accompanying drawings which are given by way of illustration only, and thus are not limitative of the present invention, and wherein.

DETAILED DESCRIPTION OF PREFERRED EMBODIMENTS

Figure 1:
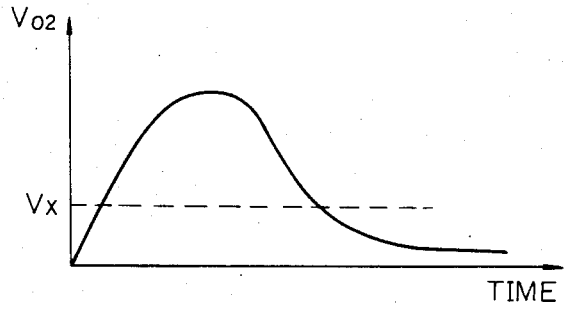
FIG. 1 is a diagram showing a response characteristic of an $O_2$ sensor.

Before entering into an explanation of an operating method according to the present invention, reference is first made to FIG. 1 in which the response characteristic curve of an $O_2$ sensor placed in a lean atmosphere is illustrated. A controller commences to supply a current to the $O_2$ sensor from immediately after the ignition switch is turned on. As shown, the combined output voltage $VO_2$ from the $O_2$ sensor which appears on the input terminal of a controller remains at zero immediately after the operation of the ignition switch, that is, the initiation of the operation of the controller circuit. This is due to an insufficient magnitude of supply current from an input circuit of the controller circuit, because of the existence of a low pass filter provided for the purpose of the rejection of noise component contained in an output signal at the $O_2$ sensor. During the transitional period of the controller circuit after the operation of the ignition switch, the combined output voltage $VO_2$, containing a voltage caused by current flowing through the $O_2$ sensor having an internal resistance, gradually increases with the activation of the input circuit. After the completion of the transitional period of the controller circuit, the combined output voltage $VO_2$ will gradually decrease again with the rising of the temperature of the $O_2$ sensor and it will stay at a sufficiently low level when the $O_2$ sensor is sufficiently warmed up, indicating that the air-fuel mixture is lean.

However, if the activation state of the $O_2$ sensor is detected by way of a comparison between the combined output voltage $VO_2$ and a reference voltage such as the voltage $V_x$ shown in FIG. 1, the erroneous discrimination mentioned before can take place due to the presence of a state in which the combined output voltage $VO_2$ is lower than the reference voltage $V_x$ ($VO_2$ $V_x$), in the transitional period after the operation of the ignition switch.

Figure 2:
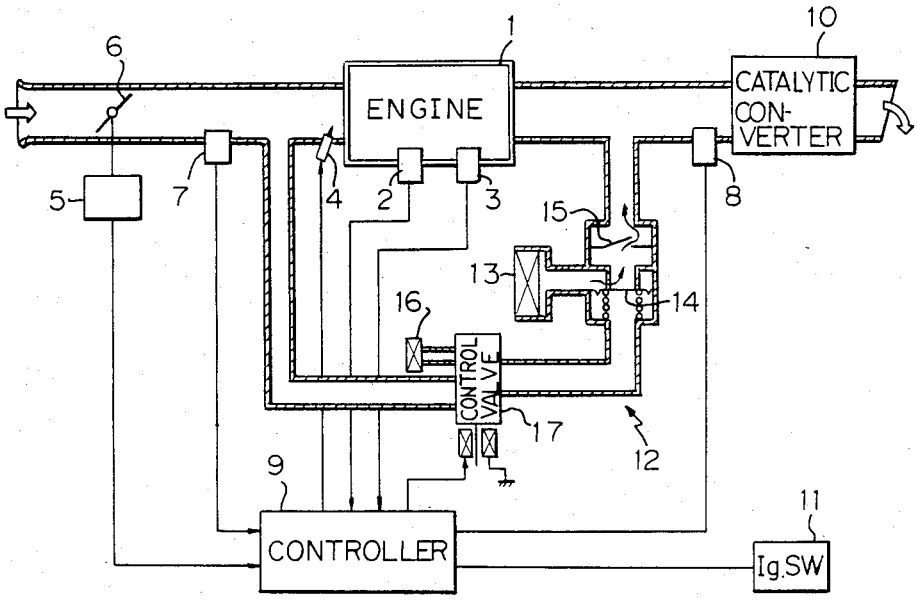
FIG. 2 is a schematic diagram showing a construction of an electronically controlled fuel supply control system in which the operating method according to the present invention is incorporated.

Reference is now made to FIG. 2 which schematically illustrates the construction of the electronically controlled fuel supply system of an internal combustion engine 1. As shown, a fuel injector 4 is disposed in an intake manifold of an internal combustion engine 1, and controlled by an output signal of a controller 9 which receives output signals of various sensors connected to the engine. Specifically, a throttle position sensor 5 is connected to a throttle valve 6 mounted in an air induction system of the engine, for producing a signal indicative of the angular position of the throttle valve 6 and transmitting the signal to the controller 9. The controller 9 also receives an output signal from an engine coolant temperature sensor 2 and a signal from a crank angle sensor 3 for sensing the rotative speed of the engine 1, and an output signal of an absolute pressure sensor 7 for monitoring an intake manifold pressure. A signal from an ignition switch 11 is also applied to the controller 9.

In an exhaust system, an $O_2$ sensor 8 is mounted to detect the oxygen content in the exhaust gas emitted by engine 1. In the exhaust system, there is also disposed a three way catalytic converter 10 which transforms HC, CO and NOx in the exhaust gas into harmless components. The engine 1 is further provided with a secondary air induction device 12 for promoting a complete oxidation of the HC and CO component in the exhaust gas. The secondary air inducation device 12 includes an air induction passageway which opens into the exhaust manifold, and having an inlet for introducing atmospheric air via a filter 13. The air from the filter 13 first flows into an atmospheric air chamber which is separated from a control chamber by means of a diaphragm 14. The atmospheric air chamber leads to a reed valve chamber in which a reed valve 15 is placed so as to be opened and closed in accordance with the pulsating pressure change of exhaust gas. The control chamber communicates with a control pressure line which selectively introduces a vacuum in the intake manifold or an atmospheric pressure through a filter 16 into the control chamber in accordance with the operation of the control valve 17. The control valve 17 is operated by the controller 9 in a manner that the vacuum of the intake manifold is introduced into the control chamber when the $O_2$ sensor 8 is not activated, and the atmospheric pressure is introduced into the control chamber when the $O_2$ sensor is activated.

With this arrangement, the diaphragm 14 separating the atmospheric air chamber and the control chamber is displaced to the side of the control chamber in accordance with the vacuum pressure from the control pressure line when the $O_2$ sensor is not activated. Thus, the atmospheric air is introduced into the reed valve chamber through a gap between the diaphragm and an annular wall of the atmospheric air chamber and therefore, the catalytic converter is supplied with a secondary air for the oxidation of the unburnt HC and CO component of the exhaust gas.

Figure 3:
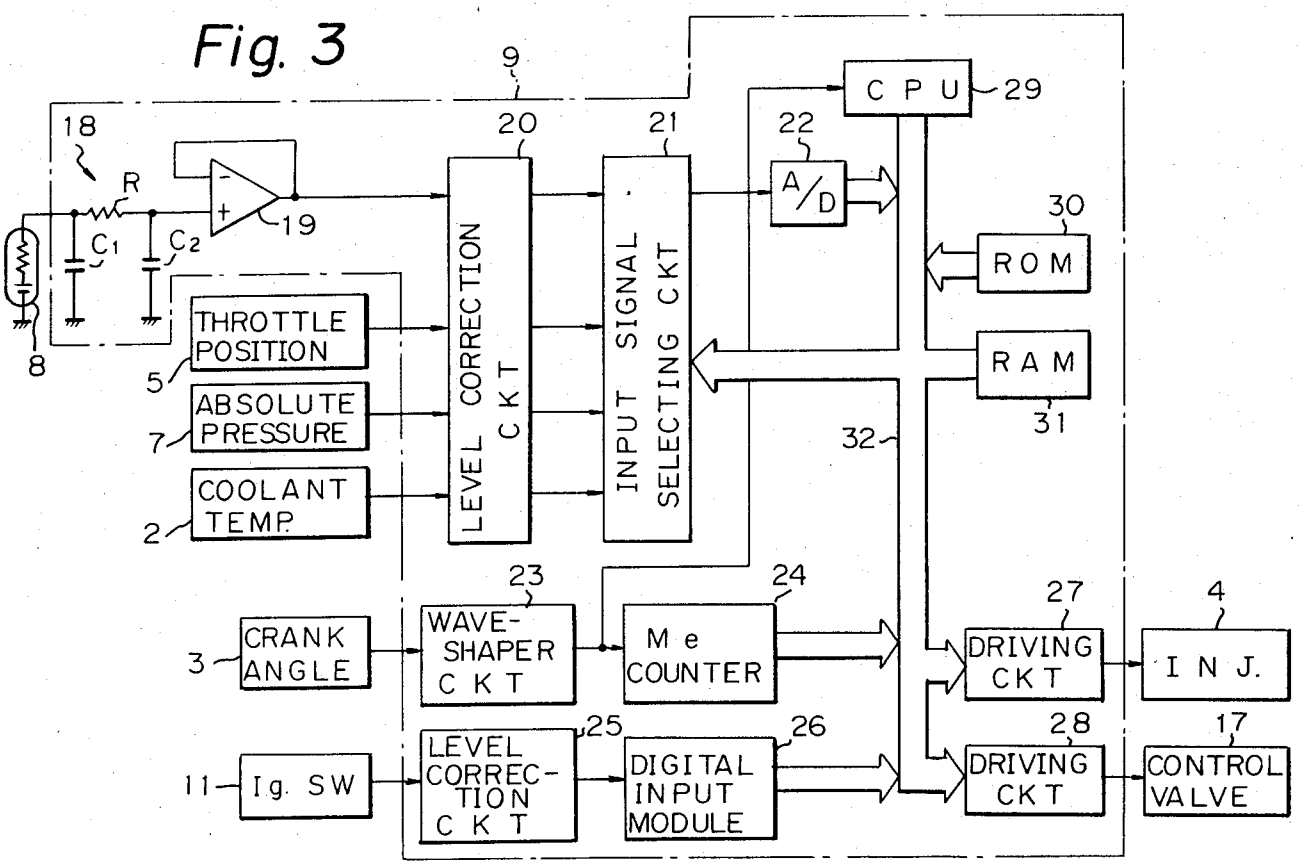
FIG. 3 is a block diagram showing the construction of a controller unit provided in the fuel supply control system of FIG. 2.

The construction of the controller 9 will be explained with reference to FIG. 3 hereinafter. As shown, the controller 9 includes a smoothing circuit 18 made up of capacitors $C_1$ and $C_2$, and a resistor R. An output signal of the smoothing circuit 18 is then applied to an amplifier 19 which includes a pnp type transistor at a first stage and amplifies the output signal of the smoothing circuit 18. The amplifier 19 commences to supply a constant current to the $O_2$ sensor through the resistor R by means of the pnp type transistor arranged at a noninverting terminal of a differential amplifier immediately after the ignition switch 11 is turned on. An output signal of the amplifier 19 is then applied to a level correction circuit 20 which also receives output signals from the throttle position sensor 5, the absolute pressure sensor 7 and the engine coolant temperature sensor 2. Output signals from the level correction circuit 20 are then applied to an input signal selecting circuit 21 which selects one of the signals from the level correction circuit 20. An analog output signal from this input signal selecting circuit 21 is then applied to an analog to digital (A/D) converter 22. An output signal of the crank angle sensor 3 is applied to a waveshaper circuit 23 which produces a pulse train synchronized with the output signal of the crank angle sensor 3. The output pulse train of the waveshaper circuit 23 is applied to an Me counter 24 which counts the time duration between each of pulses from the waveshaper circuit 23. The output pulse train of the waveshaper circuit 23 is also applied to a central processing unit (CPU) 29 for interrupting the operation. In addition, a signal which develops at a terminal of the ignition switch 11 is applied to a level correction circuit 25 whose output signal is applied to a digital input module 26. Output signals from the A/D converter 22, the counter 24 and the digital input module 26 are applied to the CPU 29 via a data bus 32 connected thereto. On the other hand, control signals obtained by the calculation in the CPU 29 in accordance with various parameters are then applied to the driving circuits 27 of the fuel injector 4 and to the driving circuit 28 of the control valve 17 of the secondary air via the data bus 32. The controller 9 also includes a read only memory (ROM) 30 for storing a program which determines the order of calculation in the CPU 29, and a random access memory (RAM) 31 for temporarily storing the data during calculation.

Figure 4:
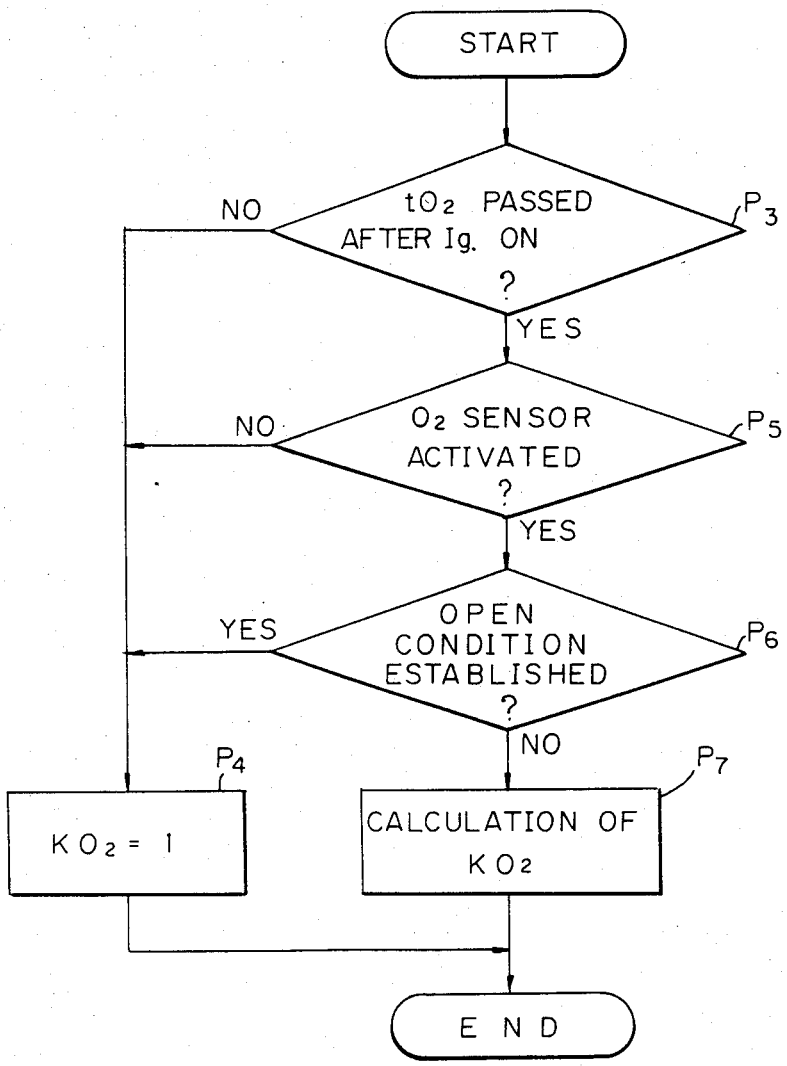
FIG. 4 is a flow chart showing a subroutine of discriminating the activation state of the $O_2$ sensor, according to the present invention.
Figure 5:
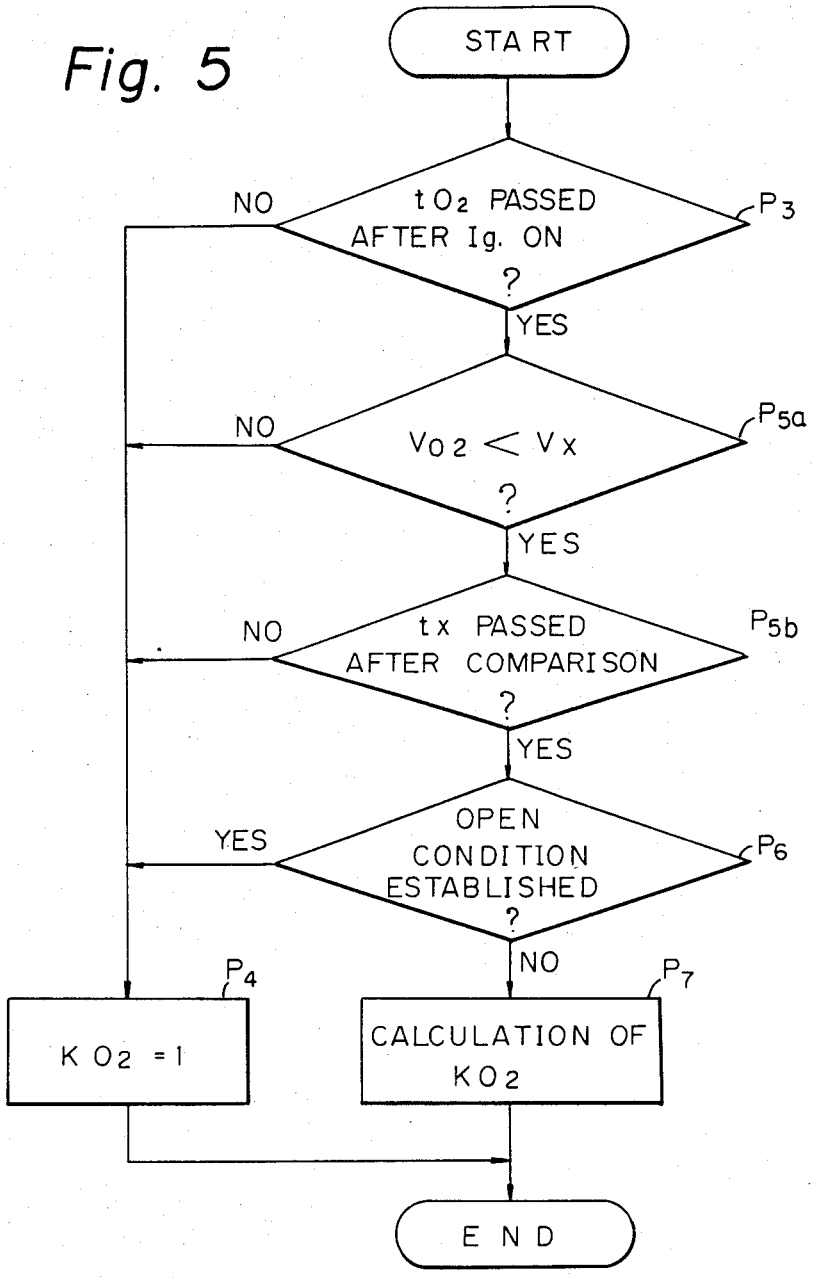
FIG. 5 is a flow chart showing the subroutine for detecting the activation state of the $O_2$ sensor of another embodiment of the present invention.

The method of air/fuel ratio control according to the present invention will be explained hereinafter with reference to flow chart of FIGS. 4 and 5 of the accompanying drawings. Reference is first made to the flow chart of FIG. 4 in which a first embodiment of the present invention is illustrated. As shown, in a step $P_3$ the controller 9 detects whether or not a time duration of five seconds has passed after the closure or turning "on" of the ignition switch 11. If the result is "no", the controller 9 fixes the feedback correction coefficient to a value "1" in a step $P_4$, so that the control loop is opened. If the result is "yes", i.e., five seconds have passed after the closure of the ignition switch 11, the controller 9 then detects, in a step $P_5$, whether or not the $O_2$ sensor is activated. The detection of the activation state of the $O_2$ sensor is performed in a way stated as follows. From immediately after the operation of the ignition switch 11, the $O_2$ sensor 8 is supplied with a predetermined electric current in accordance with the operation of the controller 9, and when the combined output voltage of the actual output voltage of the $O_2$ sensor and the voltage multiplied the current by the internal resistance of the $O_2$ sensor becomes lower than a predetermined reference voltage $V_x$ ($VO_2$ $V_x$), the controller 9 determines that the $O_2$ sensor 8 is activated by comparing the converted datum of the combined voltage $VO_2$ with the datum representative of the predetermined reference voltage Vx stored in the ROM 30.

If the result is "no" at this detection step P5, the calculation goes to the step $P_4$.

If the result is "yes" at the step $P_5$, i.e., the $O_2$ sensor has been activated, whether or not an open condition is established, is detected at a step P6. Specifically, there is a state of engine operation in which the temperature of the exhaust gas is low, such state is present during a fuel cut operation, idling state, or when the engine speed is low, and when the secondary air is supplied to the exhaust system. In such a state, it is very likely that the $O_2$ sensor is inactivated and consequently it will be detected that the air-fuel mixture is rich even if the actual state is lean because of an increase in the combined output voltage $VO_2$ by the rise of the internal resistance of the $O_2$ sensor. Therefore, the method of operation is designed that, in that case, the calculation is jumped to the step P4 so that the open loop control is executed. This open loop control is also effected while the air-fuel mixture is enriched during acceleration.

If the condition for the open loop control is not satisfied, the $O_2$ feedback correction coefficient $KO_2$ for the closed loop control will be calculated in a step P7. The subroutine for the detection of the activation state of $O_2$ sensor is thus performed.

A second embodiment of the operating method according to the present invention will be explained with reference to the flowchart of FIG. 5 hereinafter. In the case of the method of operation of this embodiment, whether or not the predetermined time period $tO_2$ has passed after the closure of the ignition switch 11, is detected in the step P3. Then the datum representative of the combined output voltage $VO_2$ is compared with the stored datum representative of the predetermined reference voltage Vx in a step P5a. If the combined output voltage $VO_2$ is lower then the reference voltage $V_x$, whether or not the predetermined time period $t_x$ has further passed, is detected in a step P5b. By this detection step P5b of further lapse of time, the completion of the activation of the $O_2$ sensor 8 is estimated. The other steps of this control method are the same as the steps in the previous embodiment, and therefore the explanation thereof is omitted.

During the period of engine starting operation in which the $O_2$ sensor is not activated, a considerable amount of unburnt component is emitted from the engine. Therefore, it is desirable to introduce the secondary air into the exhaust system in this period of the engine starting, so that the three way catalytic converter is operated under an oxidizing atmosphere, or under a lean condition. With this introduction of the secondary air, the emission of the unburnt component can be greatly reduced.

Since the detection of the activation of the $O_2$ sensor, is executed under the lean condition in the embodiments described in the above, the system is constructed so that the secondary air can be introduced into the exhaust system during the period in which the $O_2$ sensor is not activated, as previously explained with reference to FIG. 2. This is because the discrimination of the activation of the $O_2$ sensor is correctly performed under the lean condition, by comparing the combined output voltage $VO_2$ with the reference voltage $V_x$. In other words, if the $O_2$ sensor is disposed in the rich atmosphere, the combined output voltage $VO_2$ is liable to temporarily decrease because of the fluctuation of the air/fuel ratio of the exhaust gas under some engine operating condition, such as a fuel cut operation, and such an decrease of the combined output voltage $VO_2$ makes the comparison of the combined output voltage $VO_2$ and the reference voltage Vx rather difficult. Moreover, the introduction of the secondary air may be also executed during the open loop operation, such as the deceleration, in which the amount of unburnt component emitted from the engine becomes higher.

It will be appreciated from the foregoing, that according to the present invention, the discrimination of the activation of the $O_2$ sensor becomes free from a mistake, since the operation of the discrimination of the activation is started when a predetermined time period (five seconds, for example) has passed after the operation of the ignition switch. Within the predetermined time period, the combined output voltage of the $O_2$ sensor rises over the predetermined reference voltage. This is further advantageous that the drivability and the emission characteristics of the engine during the engine warming up period is greatly improved by applying a proper quantity of the fuel to the engine power cylinder.

It should be understood that the foregoing description is for illustrative purposes only, and is not intended to limit the scope of the invention. Rather, there are numerous equivalents to the preferred embodiments, and such are intended to be covered by the appended claims. As an example, in lieu of the use of the timer means for providing a predetermined time period $tO_2$ after the closure of the ignition switch, it is possible to design the program so that the initializing time of the CPU 29 after the closure of the ignition switch 11 is equal to a desirable time period. While the initializing time, CPU 29 performs predetermined sequential procedures for checking RAM 31, for determining initial values for calculation, etc. In that case, the construction of the controller 9 can be further simplified. After the $O_2$ sensor has activated, the electric current being supplied to the $O_2$ sensor may be interrupted.

What is claimed is:

1. A method for operating a closed loop air/fuel ratio control system of an internal combustion engine determining an air/fuel ratio of a combustible mixture to be supplied to the engine in accordance with an output signal of an exhaust gas oxygen sensor having a current source connected to a terminal of the exhaust gas oxygen sensor for obtaining a counter electromotive force due to an internal resistance of the exhaust gas oxygen sensor and a filter means including a capacitor connected between the terminal of the exhaust gas oxygen sensor and a ground, comprising the steps of:

supplying an electric current from said current source to said exhaust gas oxygen sensor;

discriminating whether a predetermined time period has passed after an initiation of the supply of said electric current to said exhaust gas oxygen sensor; and initiating a discrimination of an activation state of said exhaust gas oxygen sensor after the predetermined time period has passed.

2. A method as set forth in claim 1, wherein said step of initiating the discrimination comprises:

steps of comparing a level of a combined output voltage, which is a sum of an output voltage of the exhaust gas oxygen sensor indicative of the air/fuel ratio and the counter electromotive force, of said exhaust gas oxygen sensor placed in an oxidizing environment with a predetermined reference voltage level, and determining that the exhaust gas oxygen sensor is activated when the level of the combined output voltage decreases below the predetermined reference voltage level.

3. A method as set forth in claim 1, wherein said step of initiating the discrimination comprises comparing a level of a combined output voltage, which is a sum of an output voltage of the exhaust gas oxygen sensor indicative of the air/fuel ratio and the counter electromotive force, of of said exhaust gas oxygen sensor placed in an oxidizing environment with a predetermined reference voltage level, and determining that the exhaust gas oxygen sensor is activated when a predetermined time period has passed after the level of the combined output voltage has decreased below the predetermined reference voltage level.

4. A closed loop air/fuel ratio control method of an internal combustion engine in accordance with an output signal of an exhaust gas oxygen sensor placed in an exhaust system of said engine, said oxygen sensor having a current source connected to a terminal of the exhaust gas oxygen sensor for obtaining a counter electromotive force due to an internal resistance of the exhaust gas oxygen sensor and a filter means including a capacitor connected between the terminal of the exhaust gas oxygen sensor and a ground, comprising the steps of:

measuring a lapse of time after a closure of an ignition switch, a supply of an electric current from said current source to said oxygen sensor being initiated upon said closure of ignition switch;

comparing a level of a combined output voltage of said oxygen sensor with a level of a predetermined reference voltage when a predetermined time period has passed after the closure of ignition switch;

discriminating an activation state of the oxygen sensor in accordance with a result of said step of comparing;

detecting an operational state of the engine in which a temperature of an exhaust gas decreases;

calculating a feedback correction coefficient from said output signal of oxygen sensor if it is discriminated that the oxygen sensor is activated in said discriminating step and said operational state of the engine is not detected in said detection step;

fixing the feedback correction coefficient to a constant value if the above condition for permitting the calculation of feedback correction coefficient is not satisfied; and determining the quantity of fuel to be supplied to the engine in accordance with parameters including said feedback correction coefficient.

5. A closed loop air/fuel ratio control method as set forth in claim 4, wherein it is discriminated in said discriminating step that the oxygen sensor is activated if the level of the combined output voltage, which is a sum of an output voltage of the exhaust gas oxygen sensor indicative of the air/fuel ratio and the counter electromotive force, becomes lower than the level of the reference voltage signal.

6. A closed loop air/fuel ratio control method as set forth in claim 4, wherein said discriminating step comprises a step for discriminating that the oxygen sensor is activated when a predetermined time period has passed after a time at which the level of said combined output voltage, which is a sum of an output voltage of the exhaust gas oxygen sensor indicative of the air/fuel ratio and the counter electromotive force, becomes lower than the level of said reference voltage.

* * * * *